United States Patent [19]

Gray

[11] 4,192,273

[45] Mar. 11, 1980

[54] COMBUSTION MIXTURE MIXING DEVICE

[76] Inventor: Stan Gray, P.O. Box 259, Carson City, Nev. 89701

[21] Appl. No.: 489,078

[22] Filed: Jul. 17, 1974

[51] Int. Cl.[2] ..... F02M 29/00

[52] U.S. Cl. ..... 123/141; 123/119 B; 123/52 M

[58] Field of Search ..... 123/119 E, 141, 52 M

[56] References Cited

U.S. PATENT DOCUMENTS

| | | | |
|---|---|---|---|
| 1,043,580 | 11/1912 | Eldred | 123/119 E |
| 1,131,371 | 3/1915 | Hatfield | 123/141 |
| 1,727,045 | 9/1929 | Asive | 123/141 |
| 3,735,744 | 5/1973 | Brody et al. | 123/141 |
| 3,826,235 | 7/1974 | Pasbrig | 123/141 |

FOREIGN PATENT DOCUMENTS

| | | | |
|---|---|---|---|
| 13333 | of 1910 | United Kingdom | 123/141 |
| 965454 | 7/1964 | United Kingdom | 123/119 E |
| 982461 | 2/1965 | United Kingdom | 123/141 |

*Primary Examiner*—Wendell E. Burns

[57] ABSTRACT

My invention relates to internal combustion engines and its main objects are to provide improved combustion, fewer exhaust emissions, with less fuel consumption. It relates particularly to the intake manifold, where by properly positioning my device, a more efficient, catalyzed, fuel mixture is produced, resulting in exhaust emissions well below established standards, and a substantial increase in miles per gallon of fuel.

2 Claims, 2 Drawing Figures

COMBUSTION MIXTURE MIXING DEVICE

Disclosure Document No. 028960*, submitted to the COMMISSIONER of PATENTS, and dated, Feb. 27, 1974, titled, Carburetion Efficiency Unit.

Brief Summary

This device is basically a configuration of metal sleeves of pre determined diameters and lengths, preferably made of Copper because of heat conductivity, and electro plated with the catalyst, Palladium.

These devices are positioned in the cross flow of the intake manifold, one in each bore, so as to create a right angle turbulence of catalyzed gases, mixing and atomizing them, before combustion.

Figure 1:
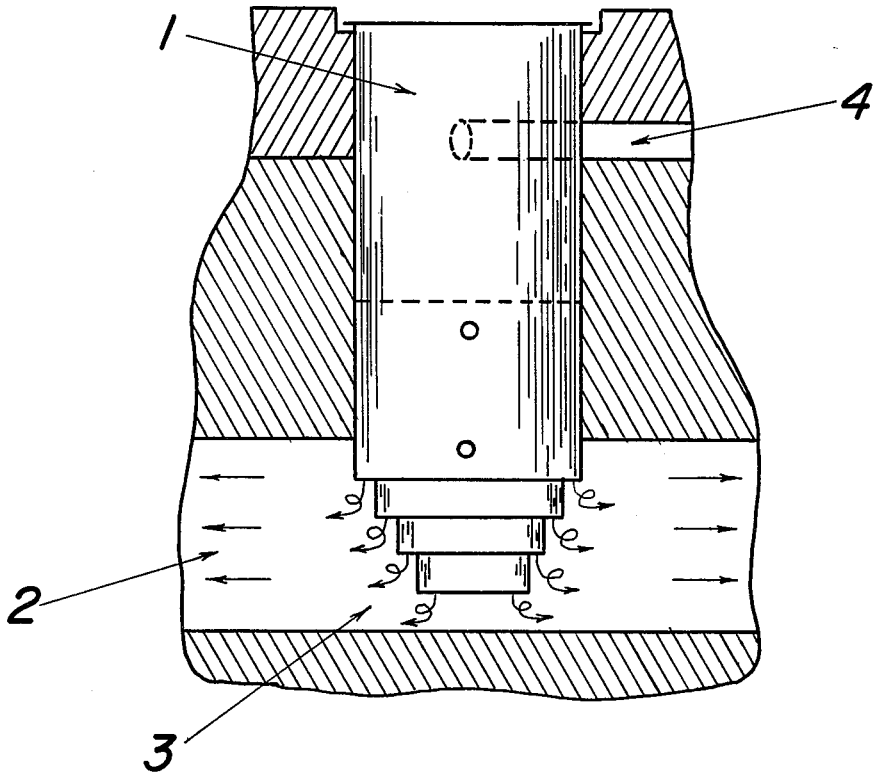
Figure 2:
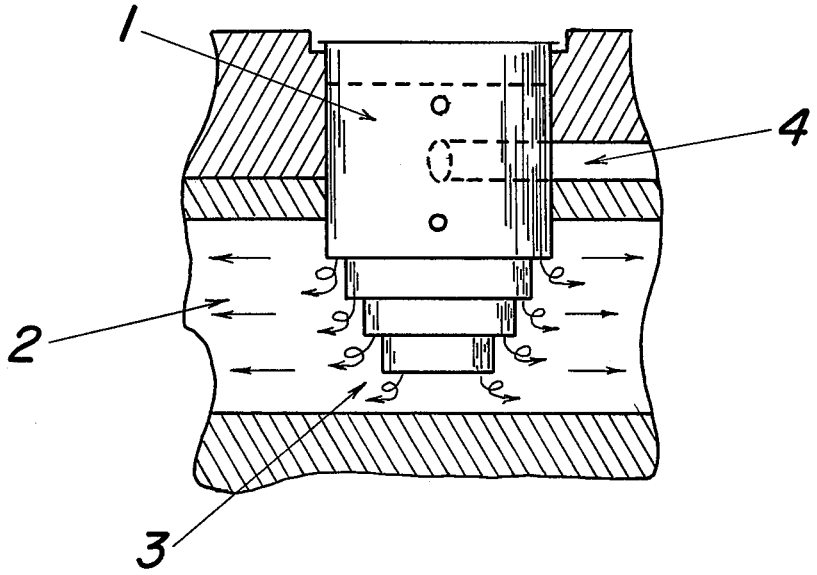

FIGS. 1 and 2 show a vertical view of two devices, of different lengths, engineered to accomodate a two bore offset intake manifold. One device is required for each bore.

The device is electro plated with the catalyst, Palladium 1, and extends into the cross flow 2, of the intake manifold. Combustibles are drawn through the device and are heated, catalyzed, and mixed, and then are forced to make a right angle turn across the bottom edges of the configuration, where they are atomized, in the cross flow turbulence 3.

A directional tube 4 is, when possible, incorporated into the device, and properly aligned with the P.C.V. (NOx) port. This equalizes the flow of catalyzed crank case emissions (NOx), to all cylinders. The freed Nitrogen, released by the catalyst, does not support combustion and serves as a retardant, or diluting agent. This action slows down combustion, making it possible to burn low octane, lead free fuels, without pre-ignition.

Carbon-Oxygen compounds, as well as Nitrogen compounds, occuring in precombustion mixture, are also catalyzed, and Oxygen released; the results are a more complete combustion with fewer Oxides in the emissions.

Sleeves are held together by 2 sections of ⅛" O.D. tubing. 2⅛" holes are drilled through the device, one near the top, and one near the bottom of the outside member, holes are countersunk, tubing is inserted, flared on ends to fit countersinks, then crimped between members, to secure.

One teaching of anchoring unit, as in drawing, is to flange top of outside sleeve into factory counterbored spacer.

Minimum air gap of 5/64", and minimum progression of 3/16" in length, should be observed to avoid condensation.

What I claim as new and desire to secure by letters patent is:

1. In combination with an internal combustion engine having an intake manifold, a device located upstream of the intake manifold for conveying combustibles into said manifold, said device comprising:

a plurality of tubular members having imperforate walls arranged concentrically about a common axis; and means mounting said tubular members so that one end of each tubular member extends through a side wall of the manifold, the lengths of each tubular member being such that said one end of each tubular member extends into the manifold a different distance with the outermost of said tubular members extending into the manifold the smallest distance, the innermost of said tubular members extending into the manifold the largest distance and any intermediate tubular members extending into the manifold by intermediate distances, said device being arranged so that the combustibles flow through the innermost tubular member and the spaces between the walls of the adjacent ones of said tubular members and then transverse to said one end of said tubular members upon entering the manifold.

2. The combination as defined in claim 1 wherein the common axis is substantially perpendicular to a wall of the manifold to create cross flow turbulence by passage of the combustibles across the ends of the tubular members which extend into the manifold.

* * * * *